US006407668B1

(12) United States Patent
Beham

(10) Patent No.: US 6,407,668 B1
(45) Date of Patent: Jun. 18, 2002

(54) AUTOMATIC GOLF CLUB SELECTING DEVICE

(76) Inventor: Thomas C. Beham, 188 Delaware Trail, Copley, OH (US) 44321

( * ) Notice: Subject to any disclaimer, the term of this patent is extended or adjusted under 35 U.S.C. 154(b) by 18 days.

(21) Appl. No.: 09/765,600

(22) Filed: Jan. 22, 2001

(51) Int. Cl.[7] ..... G08B 13/14

(52) U.S. Cl. ..... 340/568.6; 340/571; 221/208; 206/315.3; 206/315.6

(58) Field of Search ..... 340/568.6, 571, 340/572.1, 567, 693.5, 636, 687, 527; 221/208; 206/315.3, 315.6, 315.2

(56) References Cited

U.S. PATENT DOCUMENTS 2,950,748 A * 8/1960 Olinghouse ..... 206/315.6
4,029,136 A 6/1977 Jacoby
4,042,918 A 8/1977 Klitzman
5,008,954 A 4/1991 Oppendahl
5,028,909 A 7/1991 Miller
5,565,845 A 10/1996 Hara
D386,303 S 11/1997 Wang
5,973,596 A * 10/1999 French et al. ..... 340/568.6
6,023,225 A * 2/2000 Boley ..... 340/568.6

* cited by examiner

*Primary Examiner*—Anh V La

(57) ABSTRACT

An automatic golf club selecting device for selecting a certain golf club by verbally indicating which club is desired. The automatic golf club selecting device includes a plurality of lifting units for lifting a club. Each of the lifting unit comprises a selectively extendable cylindrical member. Each of the cylindrical members being mountable in a golf club bag. A motor designed for extending and retracting the cylindrical member is operationally coupled to one of the cylindrical members. A control circuitry designed for recognizing spoken golf club indicators is mountable to the golf club bag. The control circuitry is electrically coupled to each of the motors. A power supply is removably mountable in the golf club bag and is electrically coupled to the control circuitry. A microphone for receiving golf club indicators is mountable to the golf bag and is electrically coupled to the control circuitry. An actuator for turning the control circuitry on and off is mountable to the golf club bag.

15 Claims, 3 Drawing Sheets

AUTOMATIC GOLF CLUB SELECTING DEVICE

BACKGROUND OF THE INVENTION

1. Field of the Invention

The present invention relates to automatic golf club selecting devices and more particularly pertains to a new automatic golf club selecting device for selecting a certain golf club by verbally indicating which club is desired.

2. Description of the Prior Art

The use of automatic golf club selecting devices is known in the prior art. More specifically, automatic golf club selecting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,029,136; 5,565,845; 4,042,918; 5,008,954; 5,028,909; and U.S. Pat. No. Des. 386,303.

While these devices fulfill their respective, particular objectives and requirements, the aforementioned patents do not disclose a new automatic golf club selecting device. The inventive device includes a plurality of lifting means for lifting a club. Each of the lifting means comprises a selectively extendable cylindrical member. Each of the cylindrical members being mountable in a golf club bag. A motor designed for extending and retracting the cylindrical member is operationally coupled to one of the cylindrical members. A control circuitry designed for recognizing spoken golf club indicators is mountable to the golf club bag. The control circuitry is electrically coupled to each of the motors. A power supply is removably mountable in the golf club bag and is electrically coupled to the control circuitry. A microphone for receiving golf club indicators is mountable to the golf bag and is electrically coupled to the control circuitry. An actuator for turning the control circuitry on and off is mountable to the golf club bag.

In these respects, the automatic golf club selecting device according to the present invention substantially departs from the conventional concepts and designs of the prior art, and in so doing provides an apparatus primarily developed for the purpose of selecting a certain golf club by verbally indicating which club is desired.

SUMMARY OF THE INVENTION

In view of the foregoing disadvantages inherent in the known types of automatic golf club selecting devices now present in the prior art, the present invention provides a new automatic golf club selecting device construction wherein the same can be utilized for selecting a certain golf club by verbally indicating which club is desired.

The general purpose of the present invention, which will be described subsequently in greater detail, is to provide a new automatic golf club selecting device apparatus and method which has many of the advantages of the automatic golf club selecting devices mentioned heretofore and many novel features that result in a new automatic golf club selecting device which is not anticipated, rendered obvious, suggested, or even implied by any of the prior art automatic golf club selecting devices, either alone or in any combination thereof.

To attain this, the present invention generally comprises a plurality of lifting means for lifting a club. Each of the lifting means comprises a selectively extendable cylindrical member. Each of the cylindrical members being mountable in a golf club bag. A motor designed for extending and retracting the cylindrical member is operationally coupled to one of the cylindrical members. A control circuitry designed for recognizing spoken golf club indicators is mountable to the golf club bag. The control circuitry is electrically coupled to each of the motors. A power supply is removably mountable in the golf club bag and is electrically coupled to the control circuitry. A microphone for receiving golf club indicators is mountable to the golf bag and is electrically coupled to the control circuitry. An actuator for turning the control circuitry on and off is mountable to the golf club bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic golf club selecting device apparatus and method which has many of the advantages of the automatic golf club selecting devices mentioned heretofore and many novel features that result in a new automatic golf club selecting device which is not anticipated, rendered obvious, suggested, or even implied by any of the prior art automatic golf club selecting devices, either alone or in any combination thereof.

It is another object of the present invention to provide a new automatic golf club selecting device which may be easily and efficiently manufactured and marketed.

It is a further object of the present invention to provide a new automatic golf club selecting device which is of a durable and reliable construction.

An even further object of the present invention is to provide a new automatic golf club selecting device which is susceptible of a low cost of manufacture with regard to both materials and labor, and which accordingly is then susceptible of low prices of sale to the consuming public, thereby making such automatic golf club selecting device economically available to the buying public.

Still yet another object of the present invention is to provide a new automatic golf club selecting device which provides in the apparatuses and methods of the prior art some of the advantages thereof, while simultaneously overcoming some of the disadvantages normally associated therewith.

Still another object of the present invention is to provide a new automatic golf club selecting device for selecting a certain golf club by verbally indicating which club is desired.

Yet another object of the present invention is to provide a new automatic golf club selecting device which includes a plurality of lifting means for lifting a club. Each of the lifting means comprises a selectively extendable cylindrical member. Each of the cylindrical members being mountable in a golf club bag. A motor designed for extending and retracting the cylindrical member is operationally coupled to one of the cylindrical members. A control circuitry designed for recognizing spoken golf club indicators is mountable to the golf club bag. The control circuitry is electrically coupled to each of the motors. A power supply is removably mountable in the golf club bag and is electrically coupled to the control circuitry. A microphone for receiving golf club indicators is mountable to the golf bag and is electrically coupled to the control circuitry. An actuator for turning the control circuitry on and off is mountable to the golf club bag.

Still yet another object of the present invention is to provide a new automatic golf club selecting device that reduces the frustration with trying to locate the right club.

Even still another object of the present invention is to provide a new automatic golf club selecting device that will speed up the pace of game play by having the right club selected by the time the golfer gets to the ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
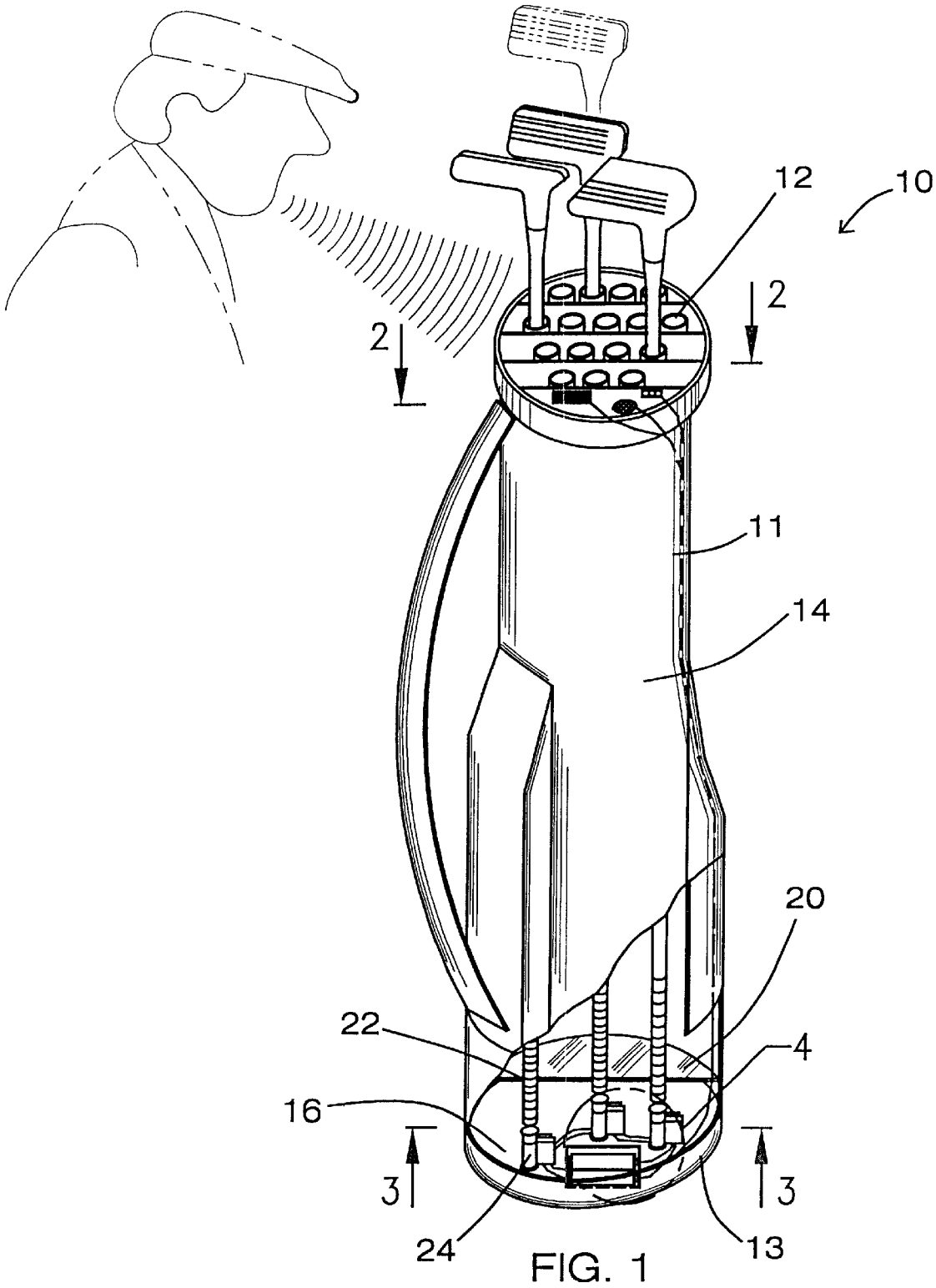
FIG. 1 is a schematic partial cut-away view of a new automatic golf club selecting device according to the present invention.
Figure 2:
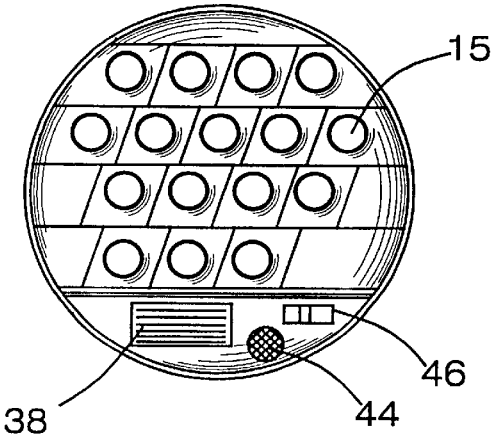
FIG. 2 is a schematic top view of the present invention.
Figure 3:
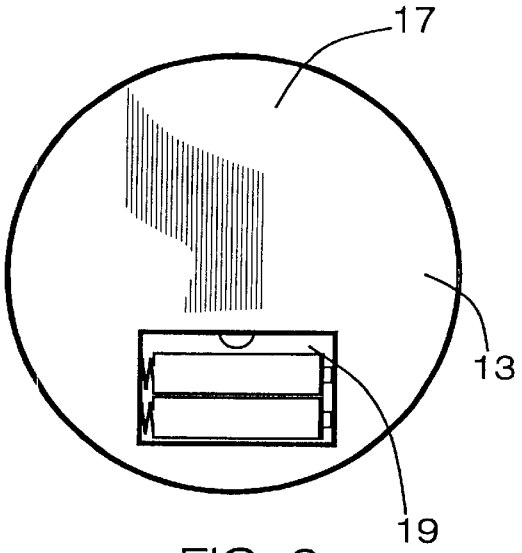
FIG. 3 is a schematic bottom view of the present invention.
Figure 4:
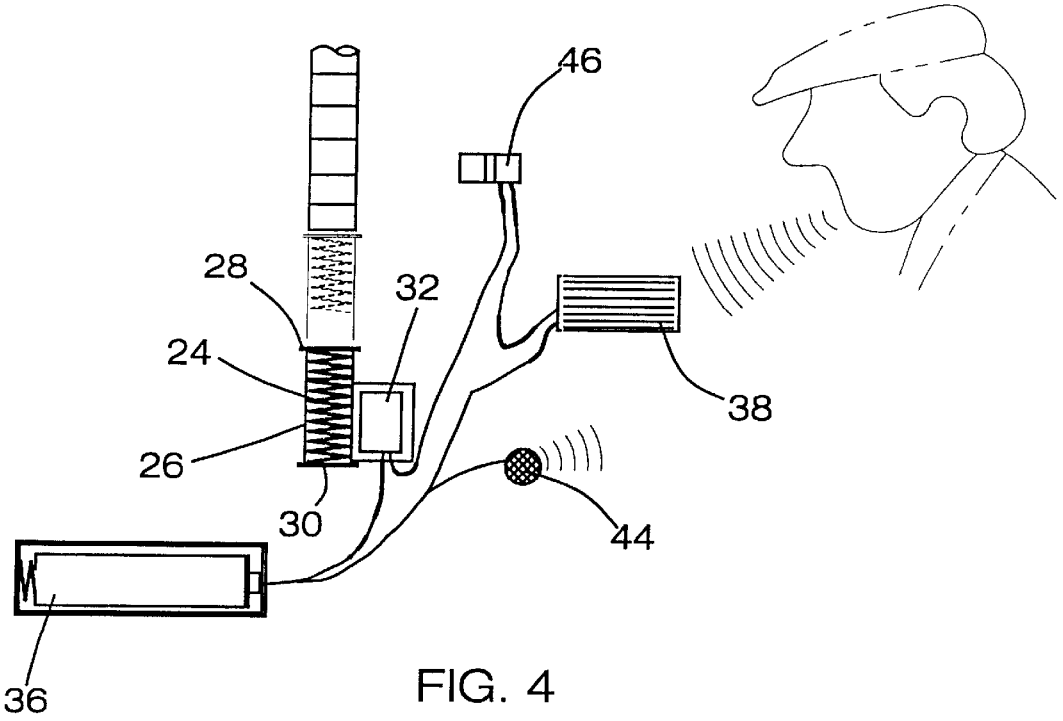
FIG. 4 is a schematic in use view of the present invention.
Figure 5:
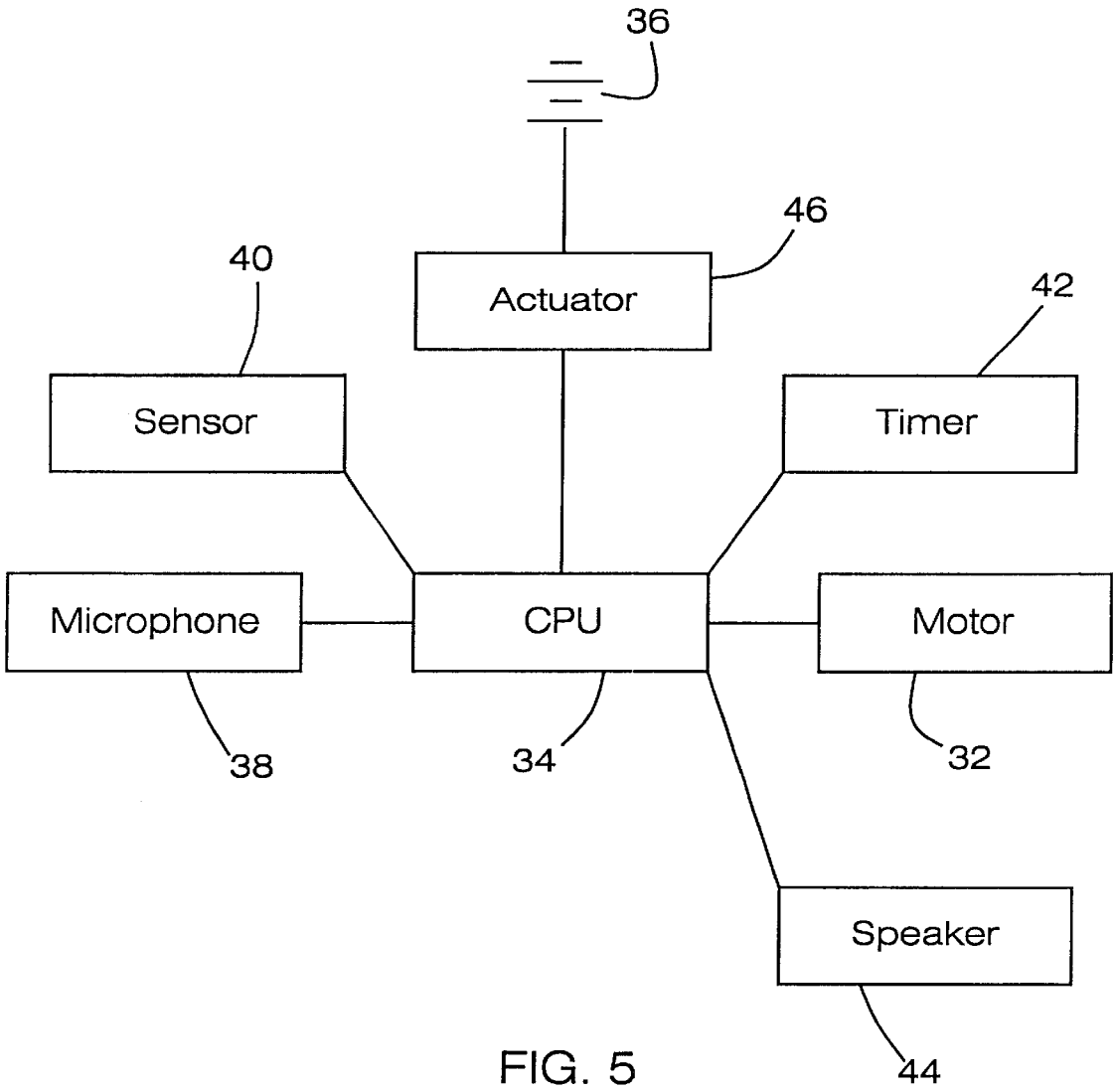
FIG. 5 is an electrical schematic view of the present invention.

With reference now to the drawings, and in particular to FIGS. 1 through 5 thereof, a new automatic golf club selecting device embodying the principles and concepts of the present invention and generally designated by the reference numeral 10 will be described.

As best illustrated in FIGS. 1 through 5, the automatic golf club selecting device 10 generally comprises an automatic golf club selecting device. The device is designed for raising and lowering a plurality of golf clubs by using a golfer's voice indicating a particular club. Each of the clubs includes a head portion and handle portion. The device preferably comprises a golf club bag 11 that includes a top wall 12 and a bottom wall 13 and a peripheral wall 14 extending therebetween.

The top wall 12 includes a plurality of holes 15 extending therethrough. The bottom wall 13 includes an upper surface 16 and a lower surface 17. The lower surface includes a well 19 extending therein. The top wall 12 may have a plurality of annular shoulders integrally coupled thereto and extending upwardly therefrom, each of the annular shoulders would be positioned generally coaxial to said plurality of holes of the top wall 12.

An intermediate wall 20 is positioned between the top and bottom walls 12 and 13 and coupled to the peripheral wall 14. The intermediate wall 14 includes a plurality of apertures 22 extending therethrough. Each of the apertures 22 is positioned generally coaxial to one of the holes 15 in the top wall 12. The apertures 22 in the intermediate wall 20 provide a means of centering the golf club handle in the bag 11. The intermediate wall 20 may be made out of any substantially lightweight and rigid material such as plastic.

There is a plurality of lifting means 24 for lifting a club. Each of the lifting means comprises a selectively extendable cylindrical member 26. The cylindrical member 26 includes a top portion 28 and a bottom portion 30. The bottom portion 30 is securably attached to the bottom wall 13 of the golf club bag 11 and positioned generally coaxial to one of the apertures 22 in the intermediate wall 20. In one embodiment, the lifting means 24 may comprise a coiled spring held under tension by a release mechanism that is removed to extend the golf club upwardly. In one embodiment, the lifting means 24 may comprise a jack screw, wherein the first portion 28 is rotatably extendable from the bottom portion 30. In another embodiment, the lifting means 24 may comprise a hydraulic lift, wherein the top portion 28 is hydraulically extendable from the bottom portion 30.

A motor 32 designed for extending and retracting the cylindrical members 26 between a first height and a second height is securably coupled to each of said cylindrical members 26.

To extend the golf clubs there is a control circuitry 34 designed for recognizing spoken golf club indicators. The control circuitry 34 is securably attached to the peripheral wall 14 of the golf club bag 11 and positioned generally between the plurality of holes 15 and the peripheral wall 14. The control circuitry 34 is operationally coupled each of the motors 32.

A power supply 36 is positioned generally in the well 19 of the bottom wall 13 of the golf club bag 11. The power supply 36 is electrically coupled to the control circuitry 34. The power supply 36 comprises a battery.

A microphone 38 is securably attached to the top wall 12 of the golf club bag 11 and positioned generally between the control circuitry 34 and the top wall 12. The microphone 38 is electrically coupled to the control circuitry 34. The microphone 38 is a conventional microphone.

A sensor 40 may be provided for detecting when a golf club has not been returned to the golf club bag 11. The sensor 40 is electrically connected to the control circuitry 34. The sensor 40 may comprise a pressure sensor or a light sensor.

A timer 42 may be provided for measuring a length of time that a golf club has not been returned to the golf club bag 11. The timer 42 is electrically connected to the control circuitry 34.

A speaker 44 may be provided for audibly signaling when a golf club has not been returned to the golf club bag 11. The speaker 44 is preferably attached to the top wall 12 of the golf club bag 11 and positioned generally adjacent to the microphone 38. The speaker 44 is electrically connected to the control circuitry 34.

An actuator 46 is provided for turning the control circuitry 34 on and off. The actuator 46 is preferably attached to the top wall 12 of the golf club bag 11 and positioned generally adjacent to the microphone 38. The actuator 46 is movably positionable between an on and an off position. The actuator 46 is operationally coupled to the control circuitry 34. The actuator 46 may comprise a switch.

In use, a golfer turns on the device by switching the actuator 46. When the golfer desires a certain club, the golfer says a certain golf club indicator into the microphone 38. The control circuitry 34 recognizes the indicator and causes the appropriate motor 32 to extend the cylindrical member 26 attached to the motor 32. The indicated golf club s extends above the other clubs and is selected by the golfer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic golf club selecting device, said device being adapted for raising and lowering a plurality of golf clubs by using a golfer's voice indicating a particular club, each of said clubs having a head portion and handle portion, said device comprising:

a plurality of lifting means for lifting a club, each of said lifting means being mountable in a bottom of a golf club bag, each of said lifting means comprising;

a selectively extendable cylindrical member having a top portion and a bottom portion;

wherein said bottom portion of said cylindrical member is mountable in an interior of the golf club bag and attached to a bottom wall of the golf club bag;

wherein said top portion of said cylindrical member is movably extendable in respect to said bottom portion of said cylindrical member, said top portion being in selective communication with one of the golf club handles extending into the golf club bag;

a motor adapted for extending and retracting said cylindrical member, each of said motors being operationally coupled to one of said cylindrical members;

control circuitry adapted for recognizing spoken golf club indicators being attachable to a peripheral wall of the golf club bag, said control circuitry being electrically connected to each of said motors;

a power supply for providing power to said control circuitry, said power supply being mountable in the golf club bag, said power supply being electrically connected to said control circuitry;

a microphone for receiving golf club indicators, said microphone being mountable to a top wall of the golf bag, said microphone being electrically connected to said control circuitry; and an actuator for turning said control circuitry on and off, said actuator being mountable to the top wall of the golf club bag, said actuator being electrically connected to said control circuitry.

2. The device of claim 1, additionally comprising a biasing means for biasing said top portion of said cylindrical members away from said bottom portion of said cylindrical member, said biasing means being mounted between said top and bottom portions of said cylindrical members.

3. The device of claim 1, wherein said cylindrical member comprises a cork screw lift, said top portion of said cylindrical member being rotatably extendable from said bottom portion.

4. The device of claim 1, wherein said cylindrical member comprises a hydraulic lift, said top portion of said cylindrical member being hydraulically expendable from said bottom portion of said cylindrical member.

5. The device of claim 1, additionally comprising a sensor for sensing when a golf club has not been returned to the golf club bag, said sensor being electrically connected to each of said control circuitry.

6. The device of claim 5, additionally comprising a timer for timing a length of time that a golf club has not been returned to the golf club bag, said timer being electrically connected to said control circuitry.

7. The device of claim 5, additionally comprising a speaker for audibly signaling when a golf club has not been returned to the golf club bag, said speaker being mountable to the top wall of the golf club bag, said speaker being electrically connected to said control circuitry.

8. An automatic golf club selecting device, said device being adapted for raising and lowering a plurality of golf clubs by using a golfer's voice indicating a particular club, each of said clubs having a head portion and handle portion, said device comprising:

a golf club bag having a top wall, a bottom wall and a peripheral wall extending therebetween, said top wall having a plurality of holes extending therethrough;

an intermediate wall being positioned between said top and bottom walls and coupled to said peripheral wall, said intermediate wall having a plurality of apertures extending therethrough;

a plurality of lifting means for lifting a club, each of said lifting means being mounted to said bottom wall of said golf club bag, each of said lifting means comprising;

a selectively extendable cylindrical member having a top portion and a bottom portion;

wherein said bottom portion of said cylindrical member is mountable in an interior of the golf club bag and attached to a bottom wall of the golf club bag;

wherein said top portion of said cylindrical member is movably extendable with respect to said bottom portion of said cylindrical member, said top portion being in selective communication with one of the golf club handles extending into the golf club bag;

a motor adapted for extending and retracting said cylindrical member being operationally coupled to one of said cylindrical members;

control circuitry adapted for recognizing spoken golf club indicators being mountable to said golf club bag, said control circuitry being electrically connected to each of said motors;

a power supply for providing power to said control circuitry, said power supply being mounted in said golf club bag, said power supply being electrically connected to said control circuitry;

a microphone for receiving golf club indicators being mountable to said golf club bag, said microphone being electrically connected to said control circuitry; and an actuator for turning said control circuitry on and off, said actuator being mountable to said golf club bag, said actuator being electrically connected to said control circuitry.

9. The device of claim 8, wherein said bottom wall of said golf club bag has an upper surface and a lower surface, said lower surface having a well extending therein, said power supply being removably positionable in said well.

10. The device of claim 8, wherein each of said apertures is positioned generally coaxial to one of said holes in said top wall.

11. The device of claim 8, wherein said cylindrical member is positioned generally coaxial to one of said apertures in said intermediate wall.

12. The device of claim 8, additionally comprising a sensor for sensing when a golf club has not been returned to said golf club bag, said sensor being electrically connected to said control circuitry.

13. The device of claim 8, additionally comprising a timer for timing a length of time that a golf club has not been returned to said golf club bag, said timer being electrically connected to said control circuitry.

14. The device of claim 8, additionally comprising a speaker for audibly signaling when a golf club has not been returned to said golf club bag, said speaker being mountable to said top wall of said golf club bag, said speaker being electrically connected to said control circuitry.

15. An automatic golf club selecting device, said device being adapted for raising and lowering a plurality of golf clubs by using a golfer's voice indicating a particular club, each of said clubs having a head portion and handle portion, said device comprising:

a golf club bag, said golf club bag having a top wall, a bottom wall and a peripheral wall extending therebetween, said top wall having a plurality of holes extending therethrough, said bottom wall having a upper surface and a lower surface, said lower surface having a well extending therein;

an intermediate wall, said intermediate wall being positioned between said top and bottom walls and coupled to said peripheral wall, said intermediate wall having a plurality of apertures extending therethrough, each of said apertures being positioned generally coaxial to one of said holes in said top wall;

a plurality of lifting means for lifting a club, each of said lifting means being mounted to said bottom wall of said golf club bag, each of said lifting means comprising;

a selectively extendable cylindrical member having a top portion and a bottom portion;

wherein said bottom portion of said cylindrical member is mountable in an interior of the golf club bag and attached to a bottom wall of the golf club bag;

wherein said top portion of said cylindrical member is movably extendable with respect to said bottom portion of said cylindrical member, said top portion being in selective communication with one of the golf club handles extending into the golf club bag a motor adapted for extending and retracting said cylindrical member between a first height and a second height;

a control circuitry adapted for recognizing spoken golf club indicators, said control circuitry being securably attached to said peripheral wall of said golf club bag and positioned generally between said plurality of holes and said peripheral wall, said control circuitry being operationally coupled each of said motors;

a power supply, said power supply being positioned generally in said well of said bottom wall of said golf club bag, said power supply being electrically coupled to said control circuitry, said power supply comprising a battery;

a microphone, said microphone being securably attached to said top wall of said golf bag and positioned generally between said control circuitry and said top wall, said microphone being electrically coupled to said control circuitry;

a sensor for sensing when a golf club has not been returned to said golf club bag, said sensor being electrically connected to each of said control circuitry;

a timer for timing a length of time that a golf club has not been returned to said golf club bag, said timer being electrically connected to said control circuitry;

a speaker for audibly signaling when a golf club has not been returned to said golf club bag, said speaker being attached to said top wall of said golf club bag and positioned generally adjacent to said microphone, said speaker being electrically connected to said control circuitry; and an actuator for turning said control circuitry on and off, said actuator being securably attached to said top wall of said golf club bag and positioned generally adjacent to said microphone, said actuator being movably positionable between an on and an off position, said actuator being operationally coupled to said control circuitry.

* * * * *